United States Patent [19]

Gravemann

[11] Patent Number: 4,702,299

[45] Date of Patent: Oct. 27, 1987

[54] MOLD FOR CONTINUOUS CASTING AND METHOD OF MAKING

[75] Inventor: Horst Gravemann, Osnabrueck, Fed. Rep. of Germany

[73] Assignee: Kabel-und Metallwerke Gutehoffnungshuette AG, Osnabrueck, Fed. Rep. of Germany

[21] Appl. No.: 794,227

[22] Filed: Nov. 1, 1985

[30] Foreign Application Priority Data

Nov. 5, 1984 [DE] Fed. Rep. of Germany ..... 3440317

[51] Int. Cl.[4] ..... B22D 11/04

[52] U.S. Cl. ..... 164/137; 164/138; 164/418

[58] Field of Search ..... 164/137, 138, 418

[56] References Cited

U.S. PATENT DOCUMENTS 4,589,468 5/1986 Misera et al. ..... 164/418

FOREIGN PATENT DOCUMENTS

| | | | |
|---|---|---|---|
| 936670 | 11/1973 | Canada | 164/418 |
| 1939777 | 2/1971 | Fed. Rep. of Germany . | |
| 3142196 | 5/1983 | Fed. Rep. of Germany . | |
| 58-192661 | 11/1983 | Japan | 164/138 |
| 2117293A | 10/1983 | United Kingdom | 164/418 |

*Primary Examiner*—Nicholas P. Godici
*Assistant Examiner*—J. Reed Batten, Jr.
*Attorney, Agent, or Firm*—Ralf H. Siegemund

[57] ABSTRACT

A mold for continuous casting has indents, grooves, or recesses in the mold wall itself and/or along one or more edges thereof; wear-proof inserts are fitted into these grooves or indents and fastened thereto by means of electron beam welding along exposed joint lines between the inserts as inserted and border edges of the indents or recesses. The inserts are affixed in this manner along edges for engagement with other mold walls, and/or along the lower edge and/or a level which is expected to coincide with the surface level of the molten steel in the mold.

12 Claims, 7 Drawing Figures

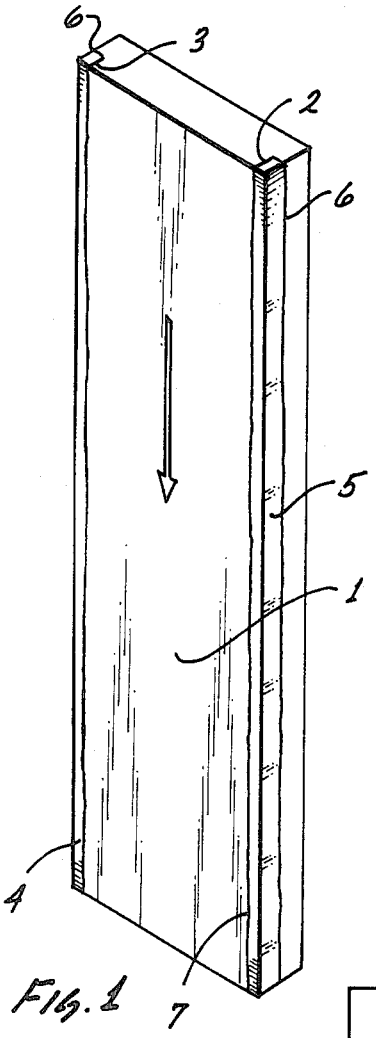
Fig. 1
Fig. 2
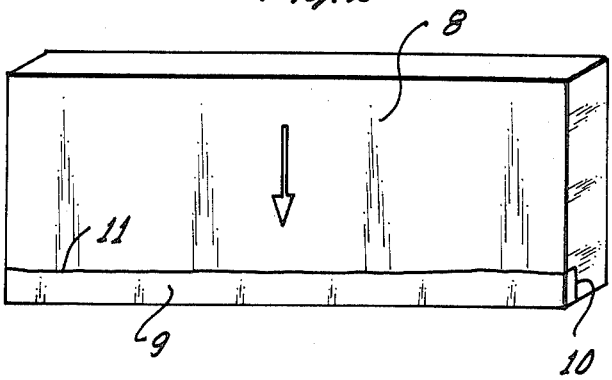
Fig. 3
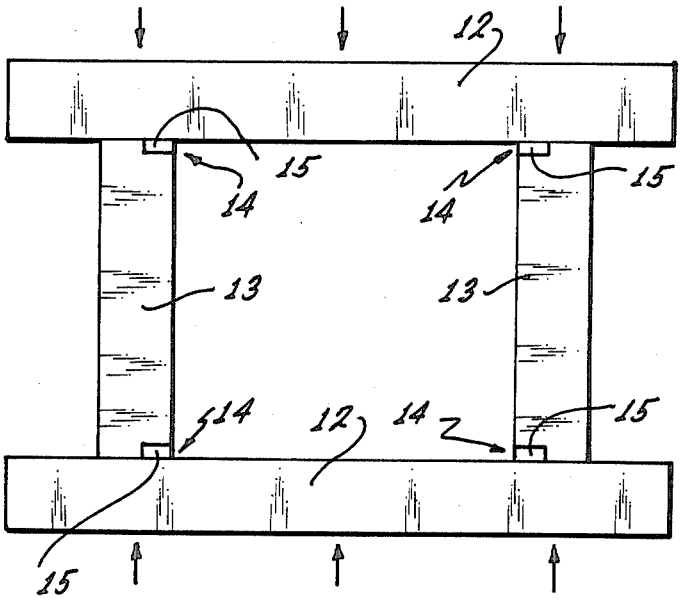

MOLD FOR CONTINUOUS CASTING AND METHOD OF MAKING

BACKGROUND OF THE INVENTION

The present invention relates to the making of a mold for continuous casting using particularly contoured wear-proof lamina, inserts or the like and cooperating in conjunction with mold walls or wall plates made of copper or copper-containing material, said walls or plates being held within a frame and being tensioned in relation to each other for establishing the mold cavity whereby, particularly, the wear-proof elements are applied in some fashion to the mold walls and are fitted into them.

Continuous casting of metal with a high melting point, such as iron or steel, uses, for example, particular types of molds made of copper or copper-containing material becuase copper was a very high thermal conductivity, which high conductivity is needed for the rapid removal of heat from the molten metal so as to permit the formation of a solidifying skin. Depending upon the particular field of use, single piece molds have to be distinguished from multiple part molds. In the case of a single piece mold, one will use seamless, forged blocks or seamlessly pressed or cast tubes or one will use welded together sheets, skelp or strip. In the case of a multiple part mold, one will use certain wall plates arranged around a mold cavity and they are tensioned to each other within a frame. These plates have to be particularly thermally treated and are subject to certain deformations.

Molds for continuous casting of the type referred to above and made basically of copper, including low or high alloyed copper alloys, will in all instances undergo friction as far as the interior wall surface defining the mold cavity is concerned. The friction is particularly exerted upon the mold by the solidifying and solidified skin, including slag particles which lodge in between the casting strand and the mold walls. This wear on account of friction amounts, in effect, to a gradual change in the geometry of the mold, particularly the internal dimensions thereof, which in turn reduces the use life of the mold to a noticeable degree. Thus, it is necessary after a certain operating period to refinish these plates in order to counteract the mechanical and/or thermal wear which the mold walls have undergone to the detriment of the relevant geometry.

The refinishing operation modifies the original cross-section of the cavity so that it is inevitable that the casting strand has slightly different dimensions before and after the refinishing work. Thus result, however, is hardly tolerable because the cross-section of the casting will vary accordingly. On the other hand, the continuous casting process is a critical one and here, particularly the rate of skin formation, the internal pressure of the liquidous metal, the withdrawl speed, and the pouring speed into the mold are all critically interrelated and even a slight deviation from the expected norm may immediately lead to a rupture of the very thin skin, just a little downstream from the bottom of the mold. Any skin rupture is, within that particular field, always rather catastrophic. Another factor to be considered is that the machine, as such, establishes a particular path for the strand from the point of emergence from the mold towards the usual horizontal transport path along which the solidified casting is removed. While other operating parameters can readily be varied, that path is a pre-established one.

A specific problem in the casting of slab ingots, billets or the like are ruptures along the edges or corners. In order to offset this defect it has been proposed to round the corners of the cavity. In particular, then, in case of molds made of plates for continuously casting ingots of relatively large cross-section, one has to round the plates or provide them with rounded edges accordingly. Considering the wear above, one can readily see that not only the flat parts of such a wall surface have to be refinished but the rounded, corner-defining portions have to be refinished also, which is a further complication.

In view of the fact that a refinished mold will without further features exhibit a larger cross-section after refinishing and reassembly than before, one needs some form of adjustment. Readjusting the mold sizes and dimensions is a very complicated procedure and is particularly time consuming. Consequently an extensive down time of the machine will have to be tolerated or a larger inventory of spare mold parts is needed.

In order to overcome these difficulties and drawbacks outlines above, it has been proposed in German printed patent application No. 1939777 (see also U.S. Pat. No. 3,662,814) to arrange particular transition pieces in the corners between the wall plates; i.e., between a longitudinal plate and a transverse plate of the mold, transition pieces are interposed, being made of a material that in some form is different as compared with the material of which the mold plates are made. These transition pieces are mechanically fastened in recesses of the two intersecting wall plates whereby the abutment surface of such a transition piece in longitudinal direction of these plates is smaller than the thickness of the respective adjoining second and intersecting wall plate. However, it was found that the high throughput and the requirements for capacity in installed machines for continuous casting are too strong to be met by these kinds of molds. This is particularly true for molds having an invariable, i.e., from the outside unadjustable cross-section of the respective cavity. But even in cases where a mold's walls are adjustable, for example, in the type of molds wherein the cross-section is varied during the casting, for example, by way of shifting the small sides, one encounters friction on the engaging surfaces between the various mold walls and they experience a very strong wear. For example, galling was observed in that grooves were actually carved into the wall. This means that such a mold wall assembly will exhibit irregular gaps and will therefore become unusable in a very short period of time, which in turn means that refinishing work has to be caried out soon after the mold has been put into use.

In order to avoid strong friction and to therefore reduce the wear, it has been tried to coat the inside wall of the copper mold plates with higher resisting material such as nickel, chromium, molybdenum, or the like. Such a coating was provided only on the longitudinal or long side walls of the mold, while the transverse or short side plates remained uncoated. Here, thin, it was suggested to provide additional lubricating grooves along the edges of engagements and to fill these grooves with a highly heat resisting grease. This method of counteracting strong friction is disadvantaged by high cost, particularly on account of the additional coating. An additional drawback is to be seen in that the mechanical wear of the casting strand does affect, to some extent, this coating, which will abrade, even though at a lesser degree, but it still experiences wear. This wear is particularly noticeable because the wear-resisting coating should be quite thin. Any such coating has to be thin simply because it constitutes a heat transfer impediment, thereby in effect raising the temperature of the casting strand and retarding the formation of a skin. Other attempts have been made to coat the transverse or small side mold plates with a hard material, for example, by means of electroplating or a chemical deposit of nickel or by applying hard metals through flame or plasma spraying. However, the results have been minimal. A problem that is encountered on employment of such coatings, particularly on the small side coatings, is, for example, an insufficient adhesion. This means, for example, that during adjusting of the mold these coatings simply chip off or spall from the wall. Moreover, such spalling is undefined and may occur very quickly after the mold has been installed. Aside from the ensuing costs for repair and renewing the coating or cover, the undefined formation of gaps between assembled wall plates are a phenomenon that occur unforeseeably and suddenly, resulting in perforations and rupture of the casting strand which, of course, is dangerous and costly.

Independent from the foregoing, and particularly independent from the type of mold, be it one of fixed cross-sectional dimension or with adjustable ones, another area where high wear is observed is the immediate exit end of the mold. There is always strong friction between the solidified skin surface of the strand and the lower end of the mold walls. In fact, this strong friction limits severely the use life of the mold. In accordance with a known proposal made in German Patent No. 31 42 196, a wear protection in this particularly endangered area can be provided by protecting this area through a layer of greater wall thickness and to apply this layer by electroplating, by spraying, or by explosion cladding. But for similar reasons outlined above this approach has not proven to be useful.

Other types of wear and resulting problems are observed along the mold wall directly underneath the surface level. On this account, the German printed patent application No. 19 57 332 proposed to place inserts into the mold wall in the range of the surface level of the bath, the insert being made of a material different from the mold wall defining plates. It was found, however, that the mere placement of such inserts—for example, through hot rolling, cladding, high speed deformation or explosion cladding—is very expensive.

DESCRIPTION OF THE INVENTION

It is an object of the present invention to overcome the deficiencies and drawbacks of the prior art and to find a possibility to control particularly the formation of gaps in the mold wall cavity so as to avoid the effects such gaps have on the casting strand and its formation.

It is a more general object of the present invention to improve generally corrosion-proofing and wear resistance of the mold wall plates, defining the mold wall cavity to thereby increase the use life of such a mold for continuous casting.

It is a particular object of the present invention to provide a new and improved method for making a mold for continuous casting, the wall being made of copper or copper containing plates which are held together and tensioned against each other within a frame and wherein inserts are provided to establish wear-proofing of at least portions of the mold wall.

In accordance with the preferred embodiment of the present invention, it is suggested to affix these inserts on and/or in the wall plates of the mold as per the specific object by means of electron beam welding. Preferably, the inserts are set into grooves, recesses or indents in the wall and the welding will occur along joint lines between insert and recess, right where the joint faces the mold cavity. It was found that this mode of fastening the inserts to the mold wall proper guarantees metallurgic bonding of the parts to be interconnected such that during the welding process itself no distortion will occur and only a very small welding zone will lose, to some extent, its strength on account of the welding. The mold has to have very accurate dimensions, and particularly the dimensions forming the mold cavity involving specifically the inner surfaces will not or hardly be interfered with by the welding process. The same is true as far as the overall cord hardness of the plates is concerned. Moreover, the metallurgic bondage of inserts and mold wall proper is such that the formation of cracks is not to be expected.

Particular advantages in accordance with further features of the invention will be observed if the inserts are made as bars of a wear-proof material and welded into the plates in the edge zones thereof. This involves particularly the area near the exit of the mold as well as those portions in which transverse and longitudinal mold wall plates exert pressure upon each other. Thus, from an aereal point of view, a rather limited zone is to remain gap free and wear proof and a suitable solution to this problem has not been possible prior to this invention. Only by means of the invention is it possible, applicable also in case of unadjustable molds to avoid the formation of gaps between transverse and longitudinal plates, for example, on account of creepae or shrinkage of the interconnected plates and being under external pressure resulting, for example, from the tensioning pressure as well as from thermal tensions occurring during casting. Also, mechanical damage will not result in the formation of the dangerous gaps.

In furtherance of the invention, the bars are welded into the corner areas of the transverse plates by means of electron beam welding. This approach is particularly advantageous if the mold is an adjustable one; this is so because upon shifting the small mold sides strong friction usually occurred as against the long side, resulting in a strong wear of the engaging surfaces which drawback is now avoided by the insertion of these bars. Another advantageous form of practicing the invention is to be seen in the additional insertion of appropriate inserts and fastening them by means of electron beam welding in those areas or zones of the mold wall which may for one reason or another experience stronger than normal wear or a wear that is stronger than elsewhere. The lower mold end has already been mentioned in this regard. Another critical zone, for example, is the zone in and/or below the bath level; inserts should be inserted extending from the bath surface level down in the direction of casting propagation. The inserts may be wedge shaped or have the shape of a truncated wedge with surfaces inclined towards each other in the direction of casting withdrawl. In order to stabilize cooling in these cases, the inserts may be made of a material which not only considers wear-proofing but also thermoconductivity should be another factor to be included in the consideration in order to increase the overall wear-proofing and in order to provide an additional control on the heat transfer from the casting into the mold wall on a localized basis. Aside from the selection of the material, the shape thereof may be critical so that particularly the shape is usable for controlling the heat transfer from the casting into the mold wall.

Wear-proof materials to be used in accordance with the invention basically consist of all weldable material. The preferred materials to be used are molybdenum; copper-beryllium alloys, but even high strength steel can be used. As a basic material to be used for the wear-proof inserts of so-called "super alloys" on a nickel base were found suitable. For example, multimaterial alloys of the system Ni-Mo-Fe with one or more of the following additives: Cr, Co, W, Ti, and Al. These alloys, or types of these alloys, are also known in the trade under various names, such as Inconel, Hastelloy, or Nimonic. Other highly strong materials on an iron basis can be used with additives of chromium, nickel, molybdenum, and aluminum. Still further materials can be temperature resisting casting—materials such as iron, nickel, or cobalt alloys. All these so-called "hard metals" are, in fact, connectable by means of electron beam welding to copper alloys, be they of the low or high alloyed variety.

DESCRIPTION OF THE DRAWING

The specification concludes with claims particularly pointing out and distinctly claiming the subject matter which is regarded as the invention. However, the invention, the objects and features of the invention, and further objects, features and advantages thereof will be better understood from the following description taken in connection with the accompanying drawings in which:

FIG. 1 is an isometric view of a wall plate improved in accordance with the preferred embodiment of the present invention for practicing the best mode thereof. Involved particularly is any kind of wall plate for a mold;

FIG. 2 is analogously an isometric view of a further improvement for a wall plate involving a different type of dimension;

FIG. 3 is a top view of a so-called "plate mold" improved in accordance with the preferred embodiment;

Figure 4:
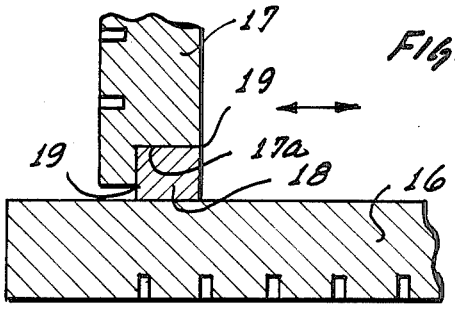
FIG. 4 illustrates a cross-section for an adjustable mold corner, showing in detail one aspect of improving the wear-proofing of that corner in accordance with practicing the best mode of the invention.

Proceeding now to the detailed description of the drawings, reference is made first to FIG. 1, which illustrates a mold wall 1 of a plate mold for continuous casting of steel. The plate is basically made of a cold formed copper alloy. The arrow on the visible front wall, being part of the interior surface of the mold wall cavity, indicates the direction of casting, being identical with the passage of the casting strand through the mold. In order to protect the edges of the mold wall, being parts of corners for the mold wall cavity, against wear and in any case regardless of whether the wall is a longitudinal or a transversal one, a long or a small side wall, and in order to avoid the formation of cracks in the mold wall on one hand, and in the casting strand on the other hand, corner grooves or recesses 2 and 3 have been milled into the wall 1. Into these grooves, respectively, bars 4 and 5 of a hard metal are inserted. The metal to be used for the bars 4 and 5 is of a highly wear-proof nature; examples of this material have been given above.

In order to fasten the bars 4 and 5 on the wall plate 1 in a secure manner and without danger of gap formation, even if the wall, as such, experiences a high thermal and/or mechanical load, the bars 4 and 5 are fastened into the grooves 2 and 3, respectively, by means of electron beam welding. Reference numerals 6 and 7 refer to the ensuing welding seams. These seams run along joint lines between insert and recess and face the interior of the mold. The seams are very limited as far as space occupancy is concerned. During welding, heating occurs in a relatively very short time and affects only a very limited amount of material, so that any softening of the surrounding mold wall involved is avoided.

FIG. 2 illustrates a mold wall plate 8 which can also serve as a longitudinal plate as well as a transverse plate. The arrow again indicates the direction of casting. The wall may be a transverse wall or a longitudinal wall, but it is simply assumed in this case that the respective orthogonal walls are provided with bars such as 4 and 5 shown in FIG. 1. FIG. 2 illustrates an additional protection in that the lower edge of the mold wall on the inside is provided with a groove into which a bar 9 of wear-proof material has been inserted, just fortifying the lower edge of the mold wall cavity. Reference numerals 10 and 11 refer again to the welding seams by means of which the bar 9 is fastened to the wall plate 8 and inserted in the respective groove thereof.

FIG. 3 is a top view, as stated, of a mold provided for continuous casting and can be considered to be a representative example of combining two plates shown in FIG. 1 with two plates shown in FIG. 2. The long walls of this mold are designated by reference numeral 12, while reference numeral 13 denotes the short side or small walls. The arrows in FIG. 3 illustrate the tensioning by means of which these walls are held together in a frame which, as such, is not shown. In order to avoid the formation of gaps in the wall, the corner areas 14, there being four such corner areas accordingly, are provided with bars 15 which have been inserted into grooves in the short mold walls 13 analogous to the insertion as shown in FIG. 1. Again, these bars 15 are fastened to the respective groove by means of electron beam welding to permanently connect the bars to the plates 13 so that together they can be considered to be a unitary structure. Of course, walls 12 are separable from walls 13.

Depending on the type of fastening, FIG. 3 can be interpreted to depict a mold of permanent cross-sectional configuration or an adjustable one. In case of an adjustable mold wherein particularly the transverse plates can be shifted vis-a-vis and along the longitudinal plates, configurations for bars and inserts have been found suitable as shown in FIG. 4. Herein are shown particularly longitudinal wall plate 16 with cooling channels cut into the outside, and there are transverse plates such as 17 connectable thereto through a suitble frame which is not shown and is conventional. The double arrow in FIG. 4 illustrates the adjustability of the plate 17 vis-a-vis the plate 16. The arrangement, however, is made such that the transverse plate 17 does not act directly upon the longitudinal plate 16, but the wear-proofing bar 18 is inserted in a groove 17*a* along the ege of plate 17 facing plate 16. The bar 18 extends from the plate 17 in the direction of its extension towards plate 16. This bar 18, therefore, is the element that directly contacts and engages the plate 16 so that the clamping pressure that holds the hold together is exerted by the plate 16 on bar 18, and vice versa, while the bar 18 is in force interaction with the plate 17, acting therefore as intermediary. The bar 18 is welded into groove 17*a* of the plate 17 by means of electron beam welding, there being welding seams 18 and 19 at the locations indicated which seams are basically exposed edges or corners. This means that the bar 18 is gap-free held on and in plate 18, and the bar 18 is tensioned against plate 16 and will retain engagement depending upon the clamping pressure.

Figure 5:
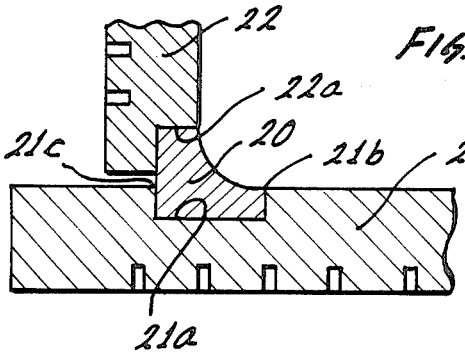
FIG. 5 is a cross-section similar to FIG. 4, but showing a different insert for a fixed wall mold.

The cross-section shown in FIG. 5 is to some extent similar to the one shown in FIG. 4, but is provided for purposes of establishing an unadjustable mold. In this case, the two mold walls 22 and 21 are in fact interconnected by the wear-proofing corner bar 20, having a rounded portion to establish a rounded transition from the surface of plate 21 facing the mold cavity to the surface of plate 22, likewise facing the mold wall cavity. The bar 20 is inserted in a groove 22*a* as well as in a groove 21*a*. Again, the bar 20 is electron beam welded, but in this case to the plate 21, there being welding seams 21*b* and 21*c* accordingly. The welding connection does not have to be made for both plates. In a typical example, if 21 is the longitudinal plate of the mold wall, it is welded to the bar 20, while the bar 20 is inserted only into the groove 22*a* of the wall 22 and the gap-free connection is established through the tensioning that is provided by the frame that holds the walls together.

Figure 6:
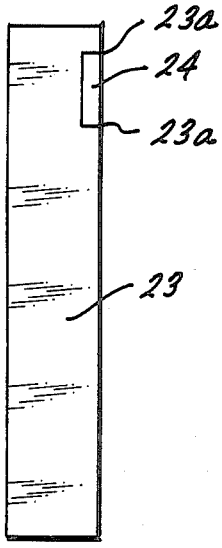
FIG. 6 illustrates a side view of a mold wall improved in accordance with the preferred embodiment of the present invention for practicing the best mode thereof within a different context.
Figure 7:
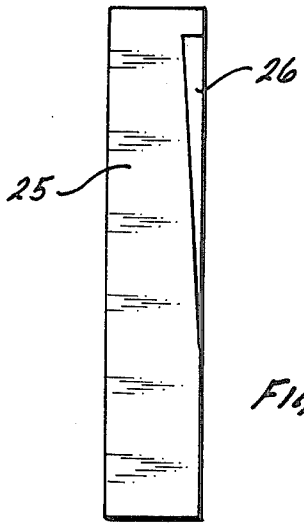
FIG. 7 is a side view similar to FIG. 6 showing how the inventive wear-proofing feature can be used in addition for purposes of controlling the heat transfer into a mold wall.

FIGS. 6 and 7 illustrate a further application of the invention. It can well be assumed that the mold walls 23 and 25 illustrated in these figures are improved in a manner shown in FIGS. 1 through 5. Now, in addition, these mold walls 23, be they longitudinal or transverse plates, are provided with a groove or indent being effective particularly as per FIG. 6 in the level expected to be the surface level of the bath of the molten metal. FIG. 6 now shows specifically that this groove receives an insert 24 made of wear-proof material of the type referred to above and being in this case merely a rectangular, more-or-less flat bar.

In order to make sure that the heat transfer between the copper plate 23 and primarily the rear wall surface of the insert 24 is as high as possible, the bar 24 has been inserted into a groove, indent or recess by means of cold rolling, press working, or even hydrostatic pressing. For certain reasons it may be necessary to use explosion forming in order to insert 24 into 23. It was found that this form of insertion and affixing rather optimizes the heat transfer conditins between the insert 24 and the mold wall 23. Nevertheless, it was found of advantage in order to avoid formation of the gaps resulting, for example, from different thermal expansion of the materials of the components 23 and 24 to provide, so to speak, a "framing" of the joint line 23*a* by electron beam welding along the borders of insert 24 as exposed. This way one obtains a metallurgic connection between the insert material and the copper or copper-containing material of the mold wall 23.

FIG. 7 can be regarded as a further development of the concept shown in FIG. 6. Herein, the function of the wedge-shaped insert 26 is, as far as wear-proofing the mold wall in the surface level is concerned, the same as shown on FIG. 6; but FIG. 7, in addition, shows that by providing the insert 26 with a dimension transverse to the wall 25 that reduces in the direction of casting (arrow), one obtains a control, i.e., a gradual increase in the heat transfer, from the casting material in the more upper level down toward the withdrawl opening. Again, this insert 26 is fastened to the mold wall 25 by means of electron beam welding, which is critical for the formation of obtaining a gap-free bond.

The invention is not limited to the embodiments described above but all changes and modifications thereof not constituting departures from the spirit and scope of the invention are intended to be included.

What is claimed is:

1. In a method for making a mold for continuous casting wherein indents, grooves or recesses are provided in the mold wall itself and/or along one or more edges thereof, the mold wall being made of copper or copper alloy plates, the improvement comprising:

fitting wear-proof inserts into these grooves, recesses or indents, the inserts being made of a different material; and fastening the inserts to the mold wall plate by means of electron beam welding along exposed joint lines between the inserts as inserted and border edges of the indents or recesses.

2. Method as in claim 1, and including using an insert made on the basis of one of the following: molybdenum; a copper-beryllium alloy; high strength steel; a super alloy using nickel; a super alloy using iron; an iron-, nickel-, or cobalt-containing casting.

3. Method as in claim 1, and including providing the recesses or grooves along edges facing the interior of the mold; fitting the inserts into the recesses; and electron beam welding them thereto.

4. Method as in claim 1 and including providing a recess as one of the recesses along the lower edge of the wall plate; fitting one of the inserts into the one recess; and electron beam welding it thereto.

5. Method as in claim 1 and including providing a recess as one of the recesses in the mold wall plate in a level in which the surface of the bath of the mold is expected to occur; fitting one of the inserts into the one recess and electron beam welding it thereto.

6. A continuous casting mold wherein a mold wall plate comprises a copper or copper-based plate having at least one indent or recess and portion or portions that will face the interior of the mold; and an insert or inserts in said recess or recesses fitted therein, being made of a high strength, wear-proofing material and being electron beam welded for connection to the plate along a joint line between the inserted insert and the mold wall plate.

7. The continuous casting mold as in claim 6, wherein said recesses are provided along two longitudinal edges bounding the same surface of the mold wall and being provided along edges that will face other mold wall plates, the inserts being bars inserted in the recesses and electron beam welded thereto.

8. The continuous casting mold as in claim 6, the wall plate having an edge defining a portion of the lower opening of the mold wall cavity, one of the recesses being along said edge, a wear-proofing bar being inserted in said recess and being electron beam welded thereto.

9. The continuous casting mold as in claim 6, having a recess along an edge, the insert being placed into the recess and projecting therefrom to act as spacer vis-a-vis another, transversely extending mold wall.

10. The continuous casting mold as in claim 6, wherein said wall has a recess in a level approximately the expected surface level of molten material in the mold cavity; an insert being inserted in said recess and electron beam welded thereto.

11. The continuous casting mold as in claim 10, wherein said insert has a rectangular cross-section.

12. The continuous casting mold as in claim 10, wherein said recess is of wedge-shaped cross-section having a tapering in a direction which will correspond to the direction of casting.

* * * * *